United States Patent [19]

Schönmeier

[11] 4,143,572

[45] Mar. 13, 1979

[54] CONTACTING OVERLAPPED CUTTING DISCS

[75] Inventor: Herbert Schönmeier, Düsseldorf, Fed. Rep. of Germany

[73] Assignee: Jagenberg-Werke AG, Düsseldorf, Fed. Rep. of Germany

[21] Appl. No.: 817,279

[22] Filed: Jul. 20, 1977

[30] Foreign Application Priority Data

Jul. 24, 1976 [DE] Fed. Rep. of Germany ..... 2633340

[51] Int. Cl.[2] ..... B26D 1/24

[52] U.S. Cl. ..... 83/501; 83/698

[58] Field of Search ..... 83/501, 502, 482, 698, 83/700

[56] References Cited

U.S. PATENT DOCUMENTS

| | | | |
|---|---|---|---|
| 3,080,784 | 3/1963 | Schneider | 83/502 X |
| 3,143,024 | 8/1964 | Markowski | 83/501 X |
| 3,380,330 | 4/1968 | Gilmore | 83/482 |
| 3,877,335 | 4/1975 | Lange | 83/501 |

*Primary Examiner*—Frank T. Yost

*Attorney, Agent, or Firm*—Sprung, Felfe, Horn, Lynch & Kramer

[57] ABSTRACT

In a cutting device of the shearing type comprising two circular blades one of which is in the form of an elastic disc displaceable on a bracket by pressure from a pressure element engaged by a lever, the cutting edge of said blade in the form of an elastic disc being disposed against the cutting edge of the other blade, the improvement wherein said bracket is disposed within a bearing sleeve which in turn is disposed within a bearing of said disc, said bearing sleeve being connected to said lever in an axially inflexible manner, said pressure element disposed adjacent to the cutting area of said blade in the form of an elastic disc and passing a moment into said bearing sleeve and said bearing which is opposed to the moment of any reaction force imposed on said disc in its cutting area.

1 Claim, 1 Drawing Figure

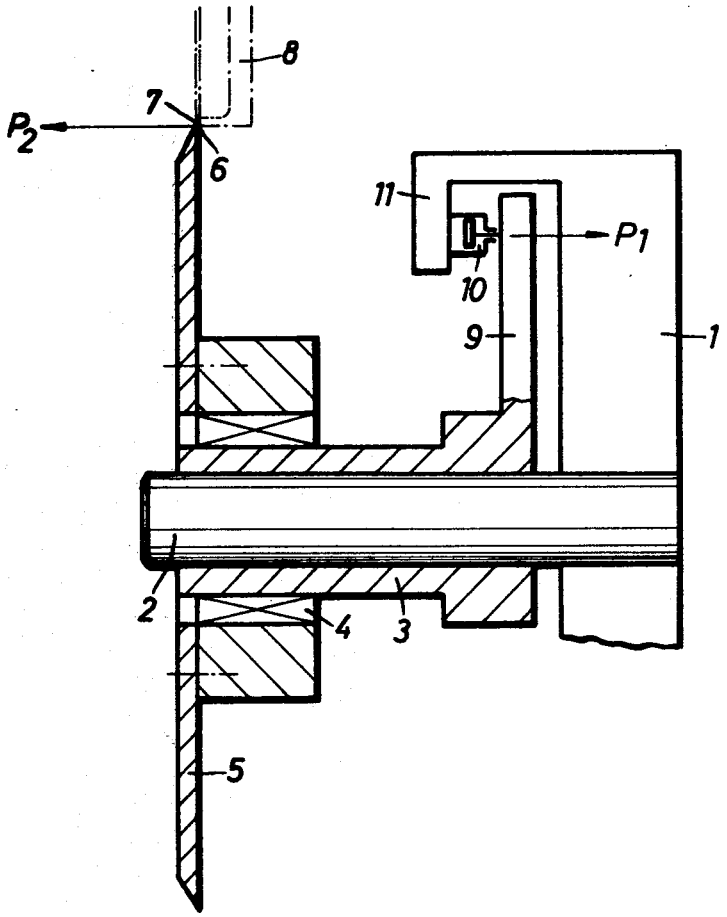
8
7
$P_2$
6
11
$P_1$
10
9
1
2
4
3
5

CONTACTING OVERLAPPED CUTTING DISCS

BACKGROUND OF THE INVENTION

1. Field of the invention

This invention relates to a cutting device according to the shearing principle with two circular blades, one blade of which in the form of an elastic disc can be displaced on a bracket and is pressed by a pressure element engaged by means of a lever with its cutting edge against the cutting edge of the other blade.

2. Discussion of the Prior Art

Such a cutting device is known from U.S. Pat. No. 3,380,330. It serves to cut the strip material longitudinally. In the known cutting device the lever is forked and presses on one side centrally onto the bearing of the elastic disc. The bearing is supported on its opposing side by a pressure spring. While the lever presses the elastic disc towards the other circular blade, the pressure spring applies force onto the disc in the opposite direction. As the forked lever acts centrally on the bearing of the elastic disc, the disc is supported by its cutting area on the opposite blade, the reaction force in the cutting area of the two blades produces a moment which acts on the bearing of the elastic disc. As long as the friction between the bearing of the elastic disc and the bracket is not negligibly low in axial direction, this acts deceivingly on the plant force of the elastic disc to be adjusted at the pressure element at the opposing blade.

Still more serious is the effect that in the case of the opposing blade being struck, for example, a possible clamping moment working between the bearing and bracket is reduced in removing the opposing blade from the elastic disc, so that the elastic disc is further shifted by the lever towards the opposing blade. If the cutting edge of the longitudinal blade then subsequently reassumes its precalculated position, a greater reaction force becomes effective on the elastic disc and thereby a greater clamping moment becomes effective between the bearing and the bracket. However, if the cutting edge of the opposing blade as a consequence of the opposite blade being struck moves in the direction of the elastic disc, the clamping moment will be increased due to the increased reaction force. The bearing of the elastic disc reacts differently depending on how the opposing blade is struck.

It is an object of this invention, therefore, to provide a cutting device of the above-mentioned type, with which the plant force of the elastic disc can be exactly adjusted at the opposing blade and in which axial impact on the cutting edge of the opposing blade cannot cause the elastic disc to shift axially on the bracket.

SUMMARY OF THE INVENTION

This object is solved according to the invention in that the axial displaceability of the elastic disc is absorbed by a ratchet brake of the bearing of the disc, whereby the lever arm is connected with the bearing of the disc so as to be axially inflexible and the pressure element is arranged next to the cutting area and passes a moment into the bearing which is opposed to the moment of the reaction force on the disc in the cutting area.

The forces with the subject of the invention are balanced in such a manner due to the special relative arrangement of the pressure element and the force direction of the pressure element regarding the force direction of the reaction force on the disc in the cutting area that no moment is applied to the bearing. As long as no impact forces become effective on the cutting edge of the disc, the bearing can be shifted axially on the bracket without the ratchet brake becoming effective. However, if the reaction force is suddenly strengthened or weakened due to the cutting edge of the opposing blade being struck the balance of forces is disturbed and a moment is applied to the bearing so that the ratchet brake can become effective. The ratchet brake works in such a manner that the elastic disc is neither shifted in one or the other axial direction.

BRIEF DESCRIPTION OF DRAWING

The invention can be more readily understood and appreciated when reference is made to the accompanying drawing which shows an embodiment of the invention in axial cross section.

DESCRIPTION OF SPECIFIC EMBODIMENT

A support 1 bears a bracket 2 on which a bearing sleeve 3 is arranged so as to be axially shiftable. A circular blade 5 in the form of an elastic disc is pivoted so as to be axially unshiftable on the bearing sleeve 3 by means of a bearing 4. The circular blade 5 abuts with its cutting blade 6 the cutting blade 7 of a circular opposing blade 8.

A lever 9 is inflexibly connected with the bearing sleeve 3. The lever 9 is positioned, in relation to the bracket 2, on the same side as the cutting area 6, 7 of the circular blades 5, 8. A pressure element in the form of a cylinder piston arrangement 10 bears upon the free end of the lever 9, said cylinder piston arrangement being supported on a support element 11 of the support 1. A pressure source (not shown) delivers a constant pressure to the cylinder.

The pressure element 10 applies a force working in the direction of arrow $P_1$ to the lever arm 9 so that the circular blade 5 is held with its cutting edge 6 in abutting relationship to the cutting edge 7 of the circular blade 8. The reaction force arising at the cutting edge 6 of the circular blade 5 is directed in the direction of arrow $P_2$, i.e., opposed to the force of the pressure element 10 onto the lever arm 9. The two forces working in the direction of arrows P;hd 1, $P_2$ are balanced so that no clamping moment can be applied onto the bearing sleeve 3 while neither of the two forces changes suddenly.

If, for example, the opposing blade 8 deviates to the right due to being struck, decrease in the reaction force on the cutting edge 6 ensues. In this case the force can apply a moment in the direction of arrow $P_1$ on the bearing sleeve 3 so that the bearing sleeve 3 becomes jammed on the bracket 2. Of course, jamming of the bearing sleeve can only ensue when both parts can work according to the invention as ratchet brakes. That is the case when the friction between the two parts is not negligibly low.

If, in the alternative case, the cutting edge 7 of the blade 8 moves in the direction of arrow $P_2$ due to being struck, the reaction force increases at the cutting edge 6 so that a clamping moment is applied from there to the bearing sleeve 3. In this case jamming of the sleeve 3 on the bracket 2 also ensues. Contrary to the prior art, the circular blade 5 of the cutting device according to the invention remains in the adjusted axial position on axial impact of the circular blade 8.

What is claimed is:

1. A cutting device comprising a pair of circular blades, one of which blades is in the form of an elastic disc, the improvement comprising a shaft, a sleeve axially displaceable on said shaft, a bearing encircling one end of said sleeve and rotatably supporting said elastic disc, a lever extending radially from the other end of said sleeve and rigidly attached thereto, and a pressure element for exerting a force in the axial direction connected to the end of said lever remote from said sleeve.

* * * * *

UNITED STATES PATENT AND TRADEMARK OFFICE

CERTIFICATE OF CORRECTION

PATENT NO. : 4,143,572

DATED : March 13, 1979

INVENTOR(S) : SCHÖNMEIER

It is certified that error appears in the above-identified patent and that said Letters Patent are hereby corrected as shown below:

Column 2, line 45, "P;hd 1," should read -- $P_1$--.

Signed and Sealed this

*Seventeenth* Day of *July 1979*

[SEAL]

*Attest:*

*Attesting Officer*

LUTRELLE F. PARKER

*Acting Commissioner of Patents and Trademarks*